US006544008B1

(12) United States Patent
Apostolides et al.

(10) Patent No.: US 6,544,008 B1
(45) Date of Patent: Apr. 8, 2003

(54) INTERNAL VENT FOR REDUCING SEAL PRESSURE IN PRELUBRICATION PUMP ASSEMBLY

(75) Inventors: John K. Apostolides, 605 Bending Oak La., Pittsburgh, PA (US) 15238; Ronald S. Lusco, Claysville, PA (US); John J. McCosby, Washington, PA (US)

(73) Assignee: John K. Apostolides, Pittsburgh, PA (US)

( * ) Notice: Subject to any disclaimer, the term of this patent is extended or adjusted under 35 U.S.C. 154(b) by 0 days.

(21) Appl. No.: 09/670,706

(22) Filed: Sep. 27, 2000

Related U.S. Application Data

(63) Continuation-in-part of application No. 08/896,779, filed on Jul. 18, 1997.

(51) Int. Cl.[7] ..... F04B 49/00
(52) U.S. Cl. ..... 417/310; 417/440; 418/104
(58) Field of Search ..... 417/310, 440; 418/206.1, 104

(56) References Cited

U.S. PATENT DOCUMENTS 2,887,058 A * 5/1959 Aspelin et al. ..... 417/310
3,146,720 A * 9/1964 Henry ..... 417/310
4,290,739 A * 9/1981 Korse ..... 418/189
4,553,512 A * 11/1985 Showman ..... 123/196 S
4,813,853 A * 3/1989 Otto et al. ..... 417/310
5,244,367 A * 9/1993 Aslin ..... 418/104
5,462,420 A * 10/1995 Stehr et al. ..... 418/83

* cited by examiner

*Primary Examiner*—Cheryl J. Tyler
(74) *Attorney, Agent, or Firm*—Cohen & Grigsby, P.C.

(57) ABSTRACT

An engine prelubrication pump includes a pump housing with a pump cavity in which a first and second gear are positioned for pumping fluid. The first gear is operably and sealably connected to a motor for rotation and the second gear is rotatably mounted to a second shaft for geared rotation with the first gear. Fluid inlet and outlet ports are located in communication with the pump cavity and adapted respectively for connection with a source of fluid and a discharge means and an internal vent is positioned in between the armature shaft of bore and the pump housing along the inlet port. Alternatively, a valve is positioned between the inlet and outlet ports to selectively permit fluid pumped between the inlet and outlet ports to pass through when the outlet port is flow restricted.

10 Claims, 4 Drawing Sheets

INTERNAL VENT FOR REDUCING SEAL PRESSURE IN PRELUBRICATION PUMP ASSEMBLY

CROSS REFERENCE

This application is a continuation in part application of U.S. application Ser. No. 08/896,779, filed on Jul. 18, 1997, entitled "Improved Pump Assembly."

FIELD OF THE INVENTION

The present invention relates to an improved engine prelubrication pump which operates with an internal combustion engine; and, in particular, to an oil pump which is driven by a starter motor armature drive shaft and which pump includes an internal vent for improved pump and motor durability. The invention is also applicable to stand alone or supplemental prelubrication pumps.

BACKGROUND OF THE INVENTION

Generally, the fluid pump of the present invention is an improvement over pumps shown U.S. Pat. Nos. 4,553,512, 4,875,551 and 4,502,431. These pumps are used to lubricate the engine prior to the initial phase of the cranking of the starter motor to turn over an engine. Typically, oil is used as a lubricant to allow engine parts to slide freely and easily with reduced friction. Notwithstanding the use of lubricants having high lubricity there continues to be abrasive wear between metal parts in internal engine components such as the turbocharger, camshaft, crank shaft and rocker assembly, for example. It has been known for some time that the greatest wear on internal engine parts is at the commencement of ignition cranking and engine start-up. During that time, there is insufficient oil pressure in the engine to provide lubrication to the various parts throughout the engine. Accordingly, for these initial moments during start-up, there is metal rubbing against metal without a sufficient lubricant interface so that deterioration in the internal engine components takes place over time.

A particularly important solution to this problem was provided by a prelubrication system disclosed in U.S. Pat. No. 4,502,431 in which oil is introduced in the engine prior to cranking and start-up. The starter motor is utilized as the means for powering the pump to provide prelubrication. In that system, the starter motor armature shaft is connected to the pump's pumping gears which are rotated to provide the pumping action to the engine to prelubricate prior to the starter motor's solenoid engaging the starter to crank the engine for start-up. One particular embodiment of the starter motor and pump combination is disclosed in U.S. Pat. No. 4,553,512 which is incorporated herein by reference.

The present invention provides a similar pump assembly as that disclosed in U.S. Pat. No. 4,553,512 to provide a selectable means for either prelubricating the engine or pumping the oil out for a quick efficient oil change. This is particularly useful to large fleet operators of vehicles which require frequent oil changes.

Accordingly, it is an object of the present invention to provide a pump mechanism to pump the oil out of an engine sump without having to open the sump's oil plug. It is a further object of the invention to provide a seal bore vent to the pump inlet to minimize the oil pressure at the seal during all modes of operation. It is a further object of the invention to provide a prelube pump having a valve which is selectively operable in the prelubrication mode as well as an oil exchange mode either from the engine compartment and/or from a time delayed mechanism.

SUMMARY OF THE INVENTION

The present invention provides a gear-type pump which is integrated to the starter motor of a vehicle. As disclosed in the aforementioned prior art, the base portion of the pump generally comprises the back or bearing end of the starter motor and includes a sealed opening through which an extended armature shaft can be mounted to rotate or power the pump gears. A pump housing is integrally formed on the base plate which provides a cavity in which the pump gears are mounted and includes an inlet and outlet port. In addition, the present invention provides a seal bore vent to the pump inlet which uses a passageway from the pump inlet into the armature shaft or pump seal bore to minimize the oil pressure at the seal during all modes of operation. This vent relieves pressure from the seal which seals the pump cavity from the motor cavity. In this way, the pump and motor are further protected from damage and their longevity enhanced. This is especially the case when a valve selector and port are provided in the pump as set forth in one of the embodiments hereof.

Additionally, the invention may include an additional port for operation of valve mechanism to permit the oil to be pumped and bypassed to the outlet port in normal operation. By rendering the valve "ineffective," oil can be pumped to the outlet port for either prelubrication or for changing the oil of the vehicle.

Other advantages of the present invention will become apparent from a perusal of the following description of a presently preferred embodiment taken in connection with the accompanying drawings.

PRESENTLY PREFERRED EMBODIMENT

Figure 1:
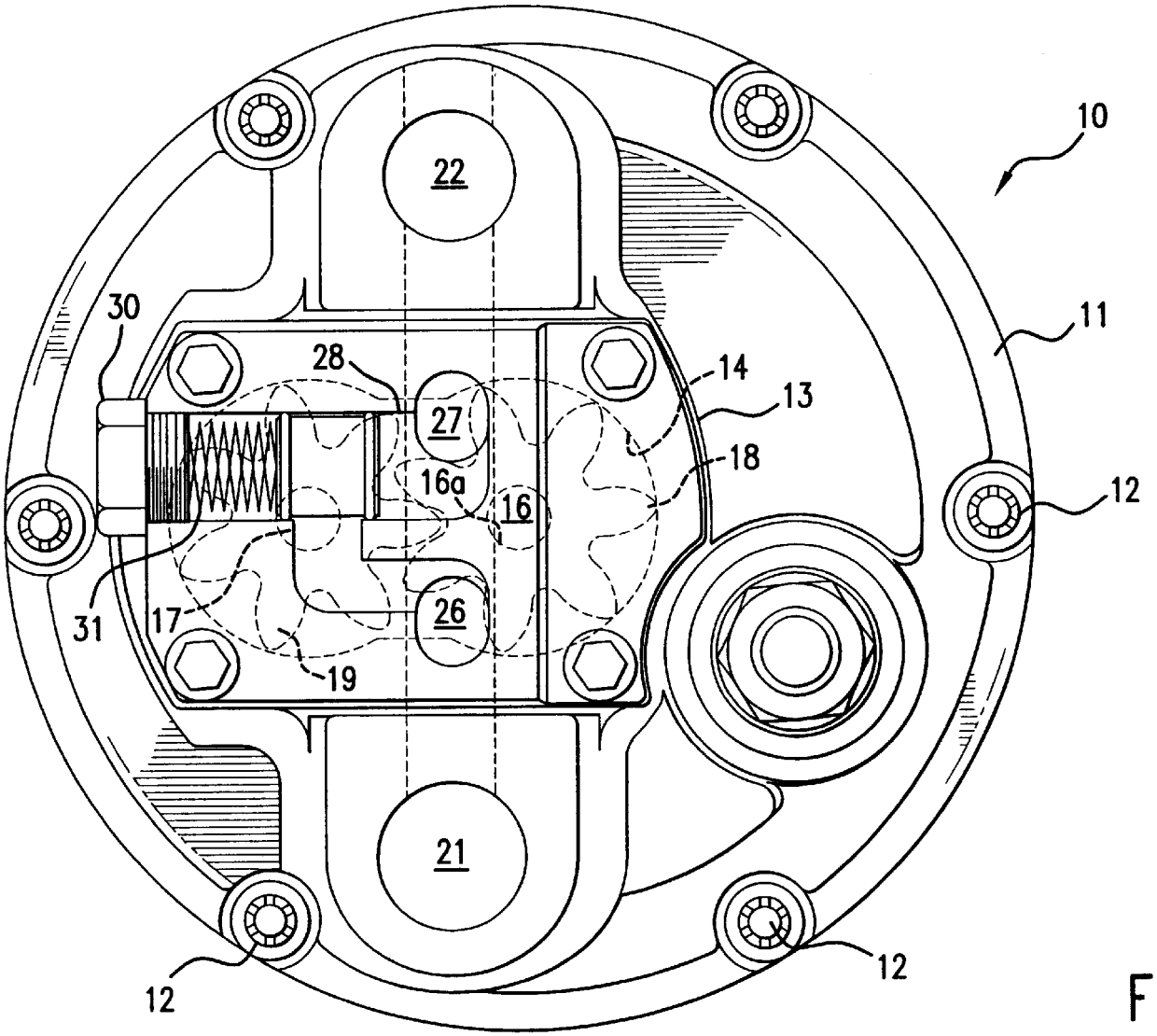
FIG. 1 is a plan view of the pump of the present invention.
Figure 2:
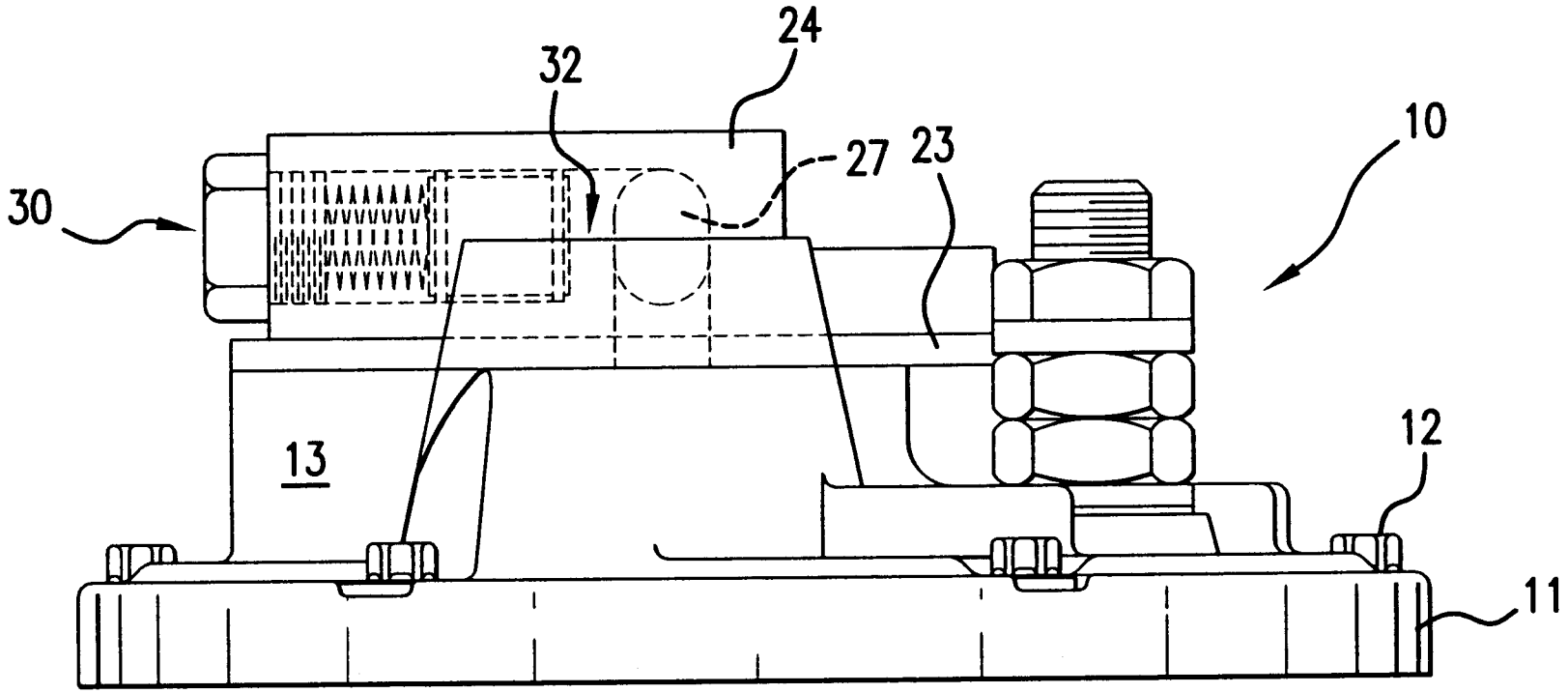
FIG. 2 is a side elevation of the pump shown in FIG. 1.

Referring to FIGS. 1 and 2, pump 10 of the present invention comprises base plate 11 which is adapted to be bolted to the back portion of a starter motor (not shown) by means of a plurality of a circumferentially positioned bolts 12. Integrally formed in base plate 11 is pump housing 13 having an elongated pump cavity 14 and central opening through which a motor or armature shaft 16 extends therein. Cavity 14 also includes idler shaft 17 mounted fixably to the other portion of the cavity. Positioned within cavity 14 are pump gears 18 and 19 which are driven by armature shaft 16.

Figure 3:
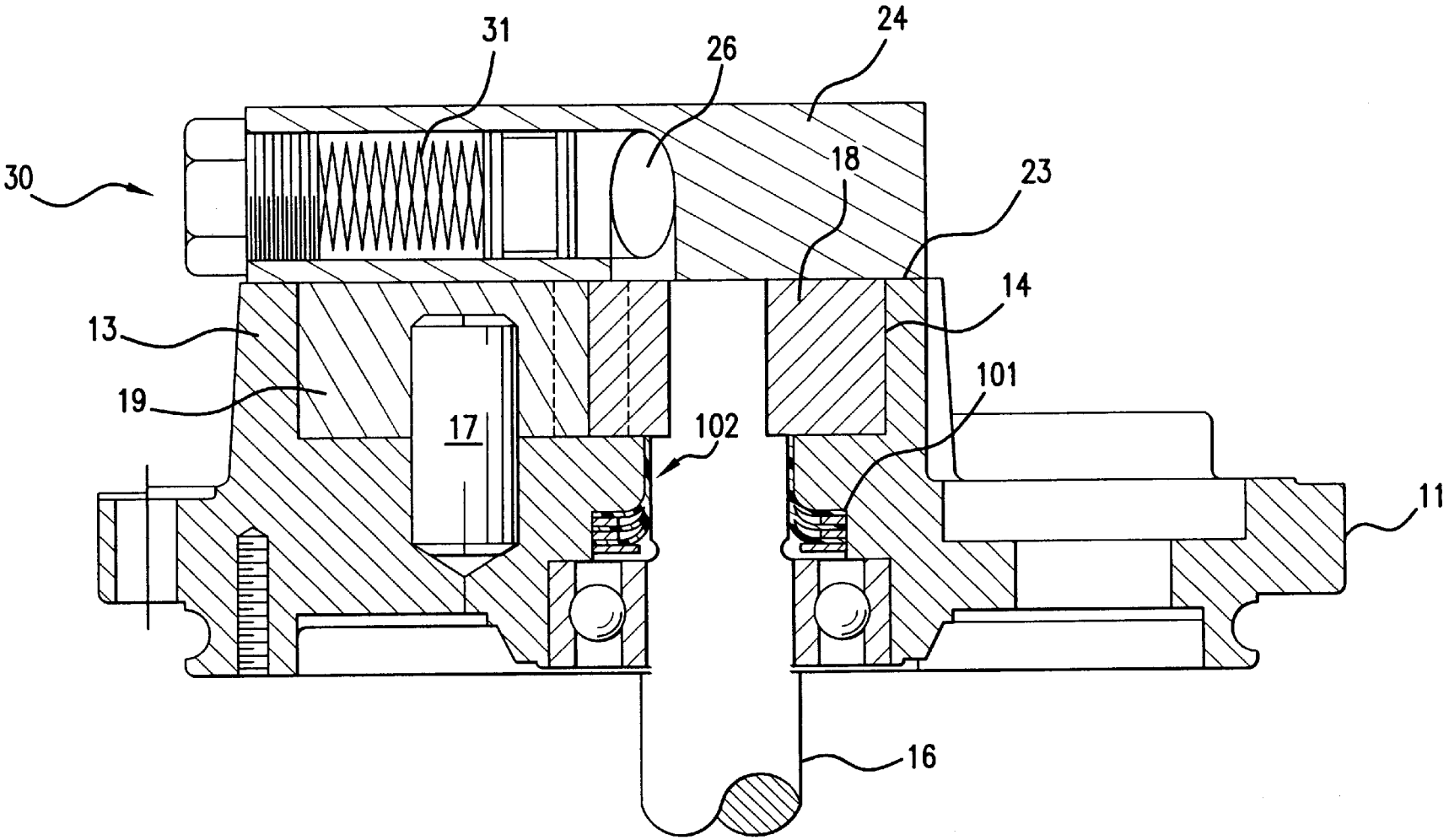
FIG. 3 is a sectional elevation of an embodiment of the present invention.

Pump housing 13 also includes inlet port 21 and outlet port 22. These ports are connected to inlet and outlet lines (not shown). Sealingly mounted to the pump housing 13 is sealing plate 23 which seals pump cavity 14 from the outside and shaft seal 101 which seals pump cavity 14 from the motor cavity, as shown in FIG. 3.

Figure 4:
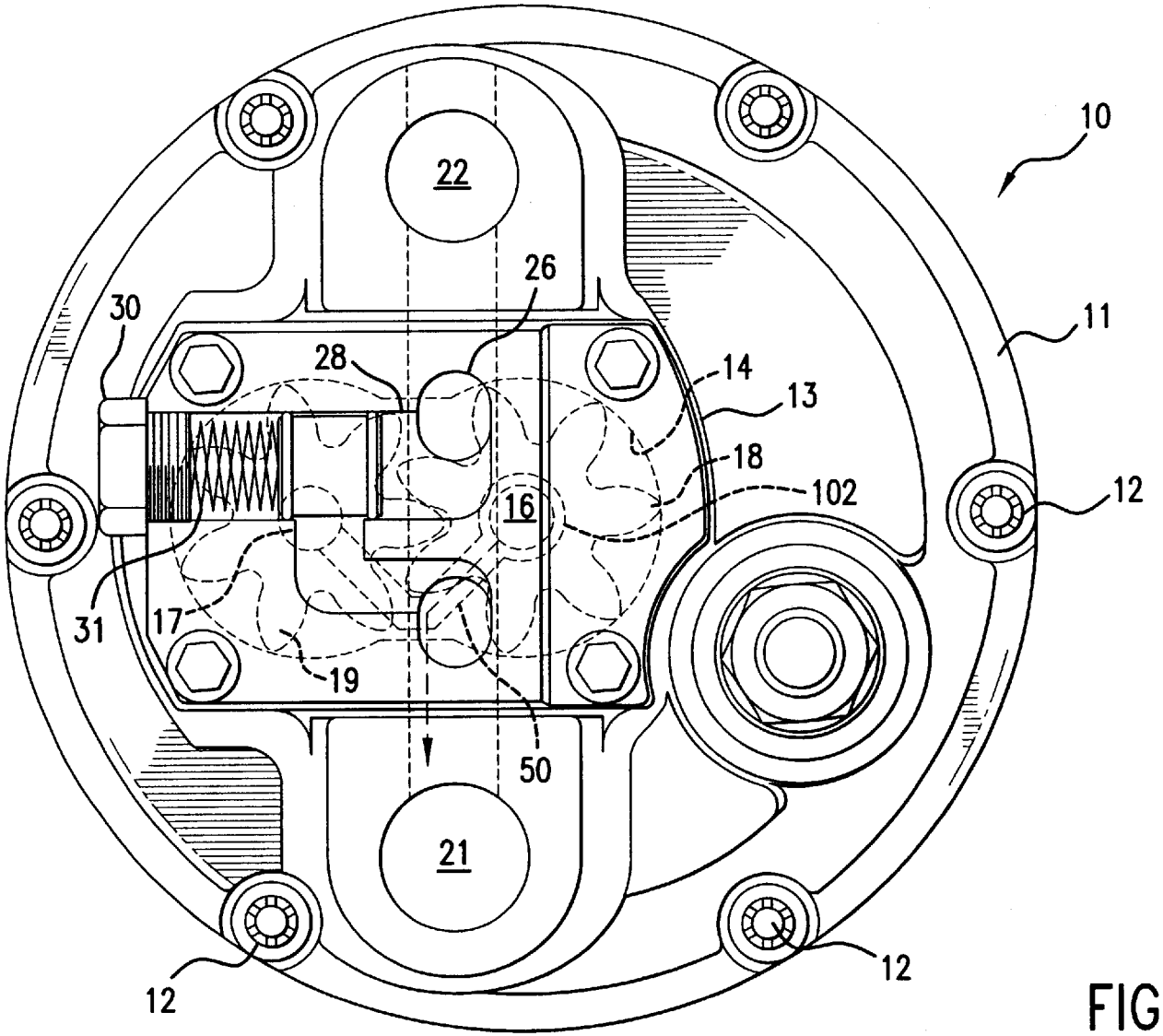
FIG. 4 provides a plan view diagram of a embodiment of the present invention showing oil flow path and pressure relief.

Pump housing 13 also includes a means to reduce pressure to the seal 101. The means may include, for example, a vent area, channel or hole in the pump or pump housing. In one embodiment, the means includes a vent 50 from the pump seal bore 102 to the pump inlet 21 which provides a passageway or otherwise connects to and is positioned within pump housing 13 on the side of inlet port 21, as shown in FIG. 4. In a preferred embodiment, the vent 50 is a grooved channel connecting with armature shaft 16 or seal bore 102 of pump housing 13 and is positioned in the pump to relieve pressure from seal 101 to prevent damage to the pump and motor. In this way, vent 50 functions to minimize the oil pressure at the seal 101, as well as at seal bore 102, during all modes of operation. FIG. 4 also shows a diagram of an embodiment of the present invention of the oil flow path through channel 28 and pressure relief through vent 50 and out suction port 21. In a preferred embodiment, vent 50 provides a self-adjusting restriction on increases to the oil pressure. Vent 50 is also applicable to stand alone or supplemental prelubrication pumps.

In a preferred embodiment sealing plate 23 includes housing 24. In another embodiment housing 24 also has a pair of bypass ports 26 and 27 which are juxtaposed for communication between inlet and outlet ports 21 and 22 respectively. A valve means, such as for example a selector valve 30 comprised of a plug spring 31, and plunger or valvehead, is positioned in channel 28 to provide selectable opening and closing of the channel. Valve means 30 is preferably a mechanically or hydraulically operated valve that is opened to permit recirculation. Alternatively, an electromechanical solenoid valve which is normally biased in the open position can be used. When the valve 30 is open, oil recirculates to the inlet port 21. In systems where rotation of the gears is normal operation oil flows through channel 28 as the pump rotates during starter motor initiation of conventional crank mode. Valve means 30 is shown having spring 31 which biases hydraulic valve means 30 closed. Oil pressure or electrical means 32 such as a solenoid opens valve 30 to permit the recirculation of oil through channel 28. In an embodiment, vent 50 is useful to prevent any excess pressure in the pump seal bore 102 of a pump having restricted channel.

In the presently preferred embodiment, the valve means 30 will be closed when outlet port 22 is open to permit oil to be pumped therethrough. Outlet port 22 may include an oil line to the engine to provide prelubrication as well known in the prior art or to a discharge receptacle, not shown, for changing the oil in the engine. A switch positioned in the engine compartment can be used to simultaneously activate the turning of the starter motor (without engaging the starter solenoid) so that the closed valve means 30 permits the oil to be pumped out of the engine. Various other arrangements can be used to control valve means 30 with oil change and/or prelubrication flow control valves (not shown) positioned at the outlet port or line.

While presently preferred embodiments of the invention have been shown and described in particularity, the invention may be otherwise embodied within the scope of the appended claims.

What is claimed is:

1. An improved engine prelubrication pump assembly for use with a motor wherein the improvement comprises:

a. a pump housing having a pump cavity;

b. a first and second gear positioned in said cavity for pumping fluid, said first gear being operably and sealably connected to a motor shaft for rotation said shaft being positioned through a seal bore, and said second gear rotatably mounted to a second shaft for geared rotation with said first gear;

c. fluid inlet and outlet ports in communication with said cavity and adapted for connection with a source of fluid and a discharge means, respectively;

d. a shaft seal which seals said pump cavity from said motor shaft; and e. an internal vent positioned between said shaft seal bore and said inlet port, wherein said vent connects said bore to said inlet port thereby decreasing the pressure in the area of said seal.

2. An improved engine prelubrication pump assembly as set forth in claim 1 wherein said first gear is operably connected to an independent motor.

3. An improved engine prelubrication pump assembly as set forth in claim 1 wherein said motor is a starter motor of a vehicle.

4. An improved engine prelubrication pump assembly as set forth in claim 3 wherein an armature of said starter motor comprises said means for rotating said first gear.

5. An improved engine prelubrication pump assembly comprising a pump housing having a pump cavity, two entrained gears positioned in said cavity for pumping fluid and fluid inlet and outlet ports in combination with said cavity, said pump assembly further including a valve means positioned between said inlet and outlet ports, said valve means being controllable to permit fluid pumped between the inlet and outlet ports to pass through said valve means when said outlet port is flow restricted, said valve means being normally closed to fluid pumped by said first and second gears to flow from said inlet port to said outlet port, during prelubrication or a fluid change, said valve means is opened to permit the oil to recirculate in response to a selective control input during operation of the pump when said prelubrication or fluid change is not selected.

6. An improved engine prelubrication pump assembly as set forth in claim 5 wherein said valve means is a hydraulic valve biased closed until a preselected pressure is established by a restriction in oil flow to the outlet port.

7. An improved engine prelubrication pump assembly as set forth in claim 5 further including a vent positioned into said pump housing along said inlet port.

8. An improved engine prelubrication pump assembly as set forth in claim 7 wherein said vent is connected to a motor shaft bore.

9. An improved engine prelubrication pump assembly as set forth in claim 5 further including a means to reduce the pressure in said pump assembly.

10. In a gear pump having a motor shaft positioned through a seal bore, fluid inlet and outlet ports in communication with a pump cavity and adapted for connection with a source of fluid and a discharge means, at least one gear disposed in said pump cavity, and a shaft seal which seals said pump cavity from said motor shaft, the improvement therein being a vent positioned between said bore and said inlet port, wherein said vent connects said bore to said inlet port thereby decreasing the pressure in the area of said seal.

* * * * *